US005197872A

United States Patent [19]

Bertomeu Martinez

[11] Patent Number: 5,197,872

[45] Date of Patent: Mar. 30, 1993

[54] CONCENTRIC BURNER SET FOR GLASS-CERAMIC GAS COOKER TOP

[75] Inventor: Francisco Bertomeu Martinez, Valencia, Spain

[73] Assignees: Catalana de Gas, S.A., Barcelona; Sergio Vidal Sospedra, Valencia, both of Spain

[21] Appl. No.: 628,953

[22] Filed: Dec. 11, 1990

[30] Foreign Application Priority Data

Dec. 11, 1989 [ES] Spain ..... 8904177

[51] Int. Cl.[5] ..... F23Q 9/00

[52] U.S. Cl. ..... 431/284; 431/328

[58] Field of Search ..... 431/284, 328, 329

[56] References Cited

U.S. PATENT DOCUMENTS

| | | | |
|---|---|---|---|
| 3,077,922 | 2/1963 | Soucie | 431/284 |
| 3,606,612 | 9/1971 | Reid | 431/284 |
| 3,843,313 | 10/1974 | Helgeson | 431/284 |
| 4,917,075 | 4/1990 | Nacenta Atmella . | |

FOREIGN PATENT DOCUMENTS

| | | | |
|---|---|---|---|
| 2051330 | 4/1971 | Fed. Rep. of Germany . | |
| 0155428 | 7/1987 | Japan | 431/329 |
| 88/09468 | 12/1988 | PCT Int'l Appl. | 431/328 |
| 1535931 | 12/1978 | United Kingdom . | |

*Primary Examiner*—Carroll B. Dority
*Attorney, Agent, or Firm*—Cushman, Darby & Cushman

[57] ABSTRACT

A set of two burners is provided for a glass-ceramic cook top. Below the usual glass-ceramic plate, the set of burners includes an inner disk-shaped burner, radially and circumferentially surrounded by an annular burner. Each burner has an inlet for a gas-air mixture, a chamber, and a honeycombed, perforated ceramic plate in which combustion is carried out, and from which infrared energy radiates for heating items which may be supported on the overlying glass-ceramic plate. The upper surfaces of the two perforated ceramic plates are preferably flat, and may be coplanar, or disposed at two different levels.

1 Claim, 1 Drawing Sheet

CONCENTRIC BURNER SET FOR GLASS-CERAMIC GAS COOKER TOP

BACKGROUND OF THE INVENTION

The present invention relates to improvements in burners are for glass-ceramic gas cooker tops.

In conventional glass-ceramic gas cooker tops, the burners covered by a glass-ceramic plate. Each burner is equipped with a combustion chamber which has a side opening for the outlet of combustion products. On the opposite side to that equipped for use, one or several burners of said fuel can be used.

The burners currently used are single chamber types, and have one radiant area or surface.

SUMMARY OF THE INVENTION

A set of two burners is provided for a glass-ceramic cook top. Below the usual glass-ceramic plate, the set of burners includes an inner disk-shaped burner, radially and circumferentially surrounded by an annular burner. Each burner has an inlet for a gas-air mixture, a chamber, and a honeycombed, perforated ceramic plate in which combustion is carried out, and from which infrared energy radiates for heating items which may be supported on the overlying glass-ceramic plate. The upper surfaces of the two perforated ceramic plates are preferably flat, and may be coplanar, or disposed at two different levels.

The nature of the burner set forming the subject of the invention, improves the use of glass-ceramic cook tops, since various calorific values can be obtained through the option of modifying the radiant surface.

The advantage of the construction and use of the burner set of the invention lies in the fact that each unit is equipped with sets of independent burner unit. Each set of burners includes two independent radiant plates or surfaces.

This is to say, the invention makes possible the use, of one or another of the radiant surfaces of any respective burner set or both at the same time. The burner can therefore supply various capacities.

The gas-air output radiant surface is formed so as to have numerous orifices in each plate. Each plate is manufactured of ceramic material and has a honeycombed surface suitable for the discharge of radiation within the infrared range.

In accordance with the invention, each burner unit has an internal cavity connected to the end of a Venturi tube through which the gas and air input is effected, as a mixture of gas and air.

The internal cavity of each burner unit is coupled to a respective ceramic plate in which the gas combustion is carried out, with the form corresponding to each independent burner.

Each internal burner cavity is independent and therefore has independent gas-air inputs.

The burner of the invention has two concentric internal cavities, one with an annulus-shaped horizontal cross-section, associated with a plate of identical shape, as seen in top plan view and the other with a circular horizontal cross; section which is identical to the shape (in top plan view) its associated end plate.

The plates can be arranged in the same, or different planes.

BRIEF DESCRIPTION OF THE DRAWINGS

In order to facilitate understanding not only of the composition but also the intended use of the burner of the invention following is a practical example of use, this description being provided merely by way of a guideline and in no way definitive, and is given with reference to the adjoining drawings, in which.

DETAILED DESCRIPTION

Figure 1:
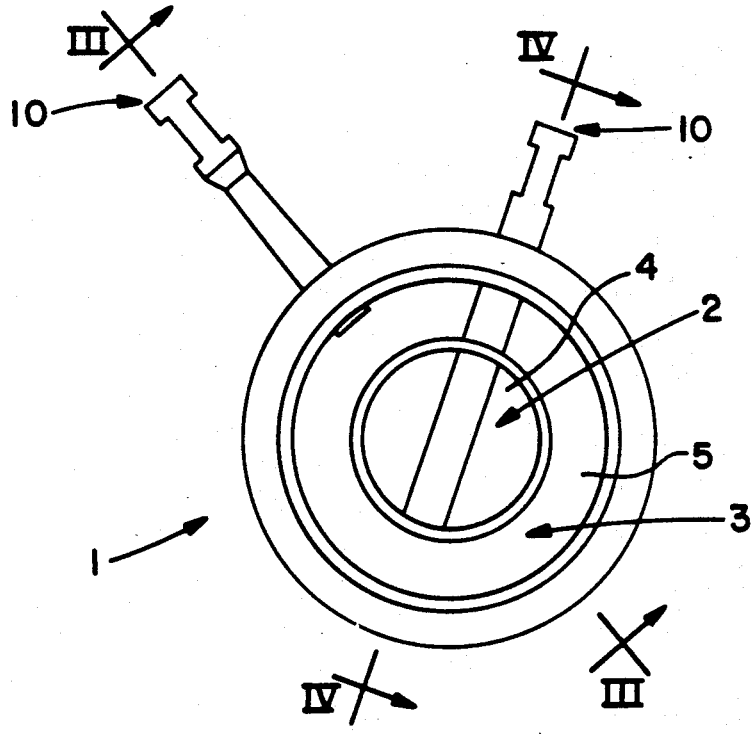
FIG. 1 shows a plan view of a burner embodying principles of the present invention, and which includes two concentric, independently operable burner units having respective radiating plates.
Figure 2:
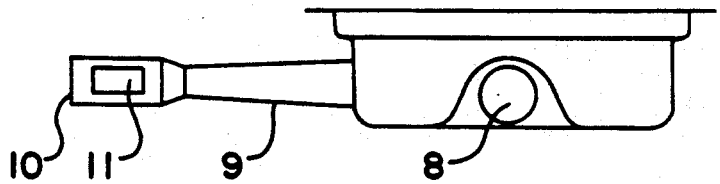
FIG. 2 shows a side elevation view of the burner of FIG. 1.

Burner 1 is formed of two burner units 2 and 3 with respective independent internal cavities 4 and 5.

Radially inner burner unit 2, which has a circular horizontal cross-section, is arranged in a concentric fashion in the annular space defined to the radially outer burner unit 3, which presents an annulus-shaped horizontal cross-section.

Burner unit 2 is equipped with a circular (i.e., disk-shaped) ceramic end plate 6 in which combustion is also carried out.

Burner unit 3 is equipped with an annular ceramic end plate 7 in which combustion is also carried out.

Figure 4:
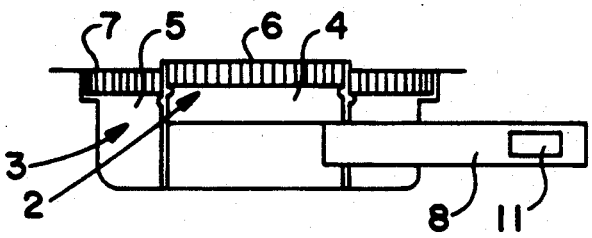
FIG. 4 shows a vertical cross sectional view of the burner, taken on line IV—IV of FIG. 1.

Along the lower sides of internal cavities 4 and 5 Venturi tubes 8 and 9 are connected, arranged in a radial direction. The input of Venturi tube 8 to cavity 4 can be from the side, as represented in FIG. 4, or along the lower part of burner unit 2, tube 8 thus forming a 90° angle instead of being a linear member. Venturi tube 8 can present convergent conical forms, as represented by tube 9. Gas enters the free end 110 of Venturi 8, 9, and respective air inputs 11 are arranged laterally. In the interior of cavities 4 and 5, mixture of the introduced gas and air is carried out, the gas-air mixture in each cavity 4, 5 being discharged through a respective diffuser for the gas-air stream, and burned in respective plates 6 and 7.

Figure 3:
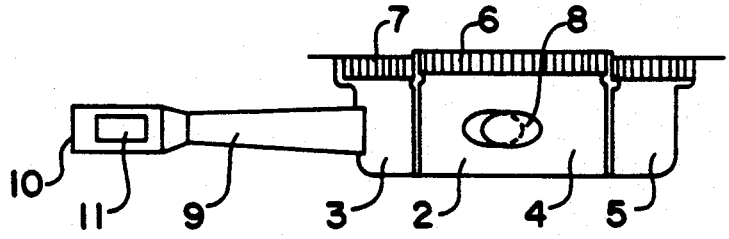
FIG. 3 shows a vertical cross sectional view of the burner, taken on line III—III of FIG. 1.

The upwardly facing, generally horizontal, external surfaces of the 6 and 7 can be coplanar, although independent, or these surfaces can be arranged in different planes, e.g., with the upper surface of the radially inner disk-shaped plate being disposed at a somewhat higher level than the upper surface of the radially outer annular plate as shown in FIGS. 3 and 4.

I claim:

1. A concentric burner set for a glass-ceramic gas cooker top, comprising:

a first, radially inner burner unit comprising:

a generally circular disk-shaped plate, as seen in top plan, having a generally horizontal, upwardly presented radiating surface, said plate being made of ceramic material, upwardly through which gas-air mixture and combustion products thereof can diffuse, wall means defining a first cavity, which is generally circular disk-shaped in horizontal cross-sectional shape and has an upper side thereof in communication with an underside of said generally circular disk-shaped plate, a first venturi tube communicating with said first cavity, said first venturi tube having an upstream end adapted for connection with a selectively variable supply of gas, and a lateral opening arranged for entrainment of air, for providing said first cavity with a supply of gas and air, to be mixed in said first cavity and diffused into said first plate for combustion so as to provide radiant energy emanating from said radiating surface; and a second, radially outer burner unit, comprising:

an annular plate, as seen in top plan, having a generally horizontal, upwardly presented radiating surface, said annular plate being made of ceramic material, upwardly through which gas-air mixture and combustion products thereof can diffuse, wall means defining a second cavity, which is annular in horizontal cross-sectional shape and has an upper side thereof in communication with an underside of said annular plate, a second venturi tube communicating with said second cavity, said second venturi tube having an upstream end adapted for connection with a selectively variable supply of gas, and a lateral opening arranged for entrainment of air, for providing said second cavity, independently of said first cavity, with a supply of gas and air, to be mixed in said second cavity and diffused into said second plate for combustion so as to provide radiant energy emanating from said radiating surface of said second plate;

said second, radially outer burner unit being coaxially arranged with said first, radially inner burner unit so as to circumferentially surround said first, radially inner burner unit;

said radiating surface of said first plate being disposed at a higher level than said radiating surface of said second plate.

* * * * *